US006422031B1

(12) United States Patent
Mandel et al.

(10) Patent No.: US 6,422,031 B1
(45) Date of Patent: Jul. 23, 2002

(54) REFRIGERATION APPLIANCE WITH IMPINGEMENT COOLING SYSTEM

(75) Inventors: Sheldon W. Mandel, East Galesburg; Behrooz Mohebbi, Peoria; Xiaoyong Fu, Galesburg, all of IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/929,079

(22) Filed: Aug. 15, 2001

(51) Int. Cl.[7] ..... F25D 17/04
(52) U.S. Cl. ..... 62/408; 62/417; 62/418
(58) Field of Search ..... 62/408, 417, 418

(56) References Cited

U.S. PATENT DOCUMENTS

| | | | | | |
|---|---|---|---|---|---|
| 2,677,241 | A | | 5/1954 | Schmock | |
| 3,559,728 | A | * | 2/1971 | Lyman | 165/55 |
| 3,590,594 | A | * | 7/1971 | Arend | 62/187 |
| 3,659,429 | A | | 5/1972 | McLean | |
| 3,747,361 | A | | 7/1973 | Harbour | |
| 3,893,307 | A | * | 7/1975 | Jacobs | 62/150 |
| 3,905,206 | A | | 9/1975 | Deubel et al. | |
| 4,021,213 | A | | 5/1977 | Neidhardt et al. | |
| 4,023,376 | A | | 5/1977 | Onodera | |
| 4,210,000 | A | | 7/1980 | Lee | |
| 4,344,291 | A | | 8/1982 | Tyree, Jr. et al. | |
| 4,358,932 | A | | 11/1982 | Helfrich, Jr. | |
| 4,368,622 | A | | 1/1983 | Brooks | |
| 4,448,029 | A | | 5/1984 | Keller | |
| 4,726,195 | A | | 2/1988 | Klee | |
| 4,972,682 | A | | 11/1990 | Smith et al. | |
| 5,149,266 | A | | 9/1992 | Heinemann et al. | |
| 5,207,762 | A | | 5/1993 | Newman | |
| 5,291,746 | A | * | 3/1994 | Abbott | 62/89 |
| 5,775,124 | A | * | 7/1998 | Park et al. | 62/408 |
| 5,899,083 | A | * | 5/1999 | Peterson et al. | 62/186 |
| 6,029,470 | A | * | 2/2000 | Joo et al. | 62/408 |
| 6,131,403 | A | * | 10/2000 | Ji | 62/186 |

FOREIGN PATENT DOCUMENTS

| | | |
|---|---|---|
| NL | 9001954 | 4/1992 |
| WO | WO 89/03008 | 4/1989 |

* cited by examiner

*Primary Examiner*—William Doerrler
*Assistant Examiner*—Mark S. Shulman
(74) *Attorney, Agent, or Firm*—Diederiks & Whitelaw, PLC

(57) ABSTRACT

A refrigeration appliance includes a large capacity refrigeration system for developing a flow of cold air that is impinged, preferably through top and side nozzles, upon food items placed within an internal cavity of the appliance to quickly freeze or chill the food items. An additional small capacity refrigeration system is provided to maintain a desired temperature within the cavity when the rapid cooling is not needed. Preferably, an impingement air diffuser arrangement is provided to direct the air flow and includes partition members to divide the internal cavity into sub-spaces for different food packages, with varying cooling rates being permissible between the various sub-spaces. A vertically adjustable shelf is provided which cooperates with blocking plates which move up and down with the shelf and function to block air flow through nozzles arranged below the shelf such that all of the developed air flow is used for direct impingement on the food product.

23 Claims, 4 Drawing Sheets

REFRIGERATION APPLIANCE WITH IMPINGEMENT COOLING SYSTEM

BACKGROUND OF THE INVENTION

1. Field of the Invention

The present invention pertains to the art of refrigerators and, more particularly, to a refrigerator appliance incorporating a rapid cooling system.

2. Discussion of the Prior Art

A typical refrigeration system includes a compressor, an evaporator, a condenser and an expansion device, used in combination with either a blower or natural convection, to develop and direct a flow of cooling air into a compartment to be refrigerated. A common household refrigerator is typically configured to establish and maintain a selected temperature environment within a compartment thereof with a flow of cooling air being directed to a freezer compartment and a percentage of that air being diverted into a fresh food compartment such that the freezer compartment is maintained at a lower temperature. Deep freezers, which also include corresponding refrigeration system components, are also known in the art. In some known systems, provisions are made for rapidly cooling food items placed in a compartment of the unit. These deep freezers can be utilized for various purposes, particularly in connection with rapidly freezing food items which can deteriorate or spoil rather quickly if exposed to higher temperatures. Often times, provisions are made to direct a refrigerating agent into the compartment of the freezer to perform the rapid cooling function.

In general, deep freezer arrangements are not found in common households, mainly due to the fact that known deep freezers have a single dedicated function and there is a general lack of need to rapidly freeze a large amount of food products in this environment. However, it would be beneficial to provide a refrigeration appliance which could be used in various modes of operation to efficiently and effectively enable a consumer to take advantage of the ability to rapidly freeze food items, while also not requiring the appliance to be dedicated to performing such a task. In addition, there is considered to be a need in the art for a refrigeration appliance that could be used to quickly freeze food items, but which can also be used to simply chill or maintain food at a desired temperature, preferably in a domestic household environment. Furthermore, there exists a need for a more efficient and effective quick freezing system for a refrigeration appliance that can be used in the household environment.

SUMMARY OF THE INVENTION

The invention is directed to a refrigeration appliance used to quickly freeze or chill food or beverage items. The appliances can fit under a standard kitchen cabinet in a manner generally analogous to a dishwasher or be provided as a stand alone unit. A large capacity vapor compression refrigeration system is incorporated to develop a flow of circulated cold air that is delivered to an insulated cavity of the appliance. The cavity may be accessed through a drawer, door or the like and can contain accessories such as baskets, shelves, etc. The flow of cold air is preferably discharged from the top and sides, with return air being routed through a bottom space.

In a preferred form of the invention, an additional, small capacity refrigeration system is also incorporated in the appliance to provide cooling, preferably through natural convection, to maintain a desired temperature within the cavity when the rapid cooling is not needed. A thermal storage medium, such as a phase-change material having an associated high latent heat of fusion, may also be provided. Here, the large refrigeration system is used to freeze the phase change material and then the cavity is maintained in a desired temperature range by passing a flow of air developed by an auxiliary fan over the phase change material or through the use of the small capacity refrigeration system. The phase change material can also be used as thermal storage to supplement the cooling capacity for the blast freezing in connection with the large refrigeration system.

In a further aspect of the invention, an impingement air diffuser arrangement is provided within the cavity to direct the air flow used for product freezing or cooling to top and side ports, preferably defined by an array of nozzles. These nozzles can be round or slotted in accordance with the present invention and function to direct an impinging flow of cold air directly onto the food product. The configuration of the diffuser can be altered to define sub-spaces within the cavity for different food packages. In a preferred form of the invention, a vertically adjustable shelf support arrangement is provided within the cavity, with the shelf being made of a finned metal. The shelf cooperates with blocking plates which move up and down with the shelf and function to block air flow through a predetermined number of nozzles arranged below the shelf, such that all of the developed air flow is used for direct impingement on the food product.

Additional objects, features and advantages of the present invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
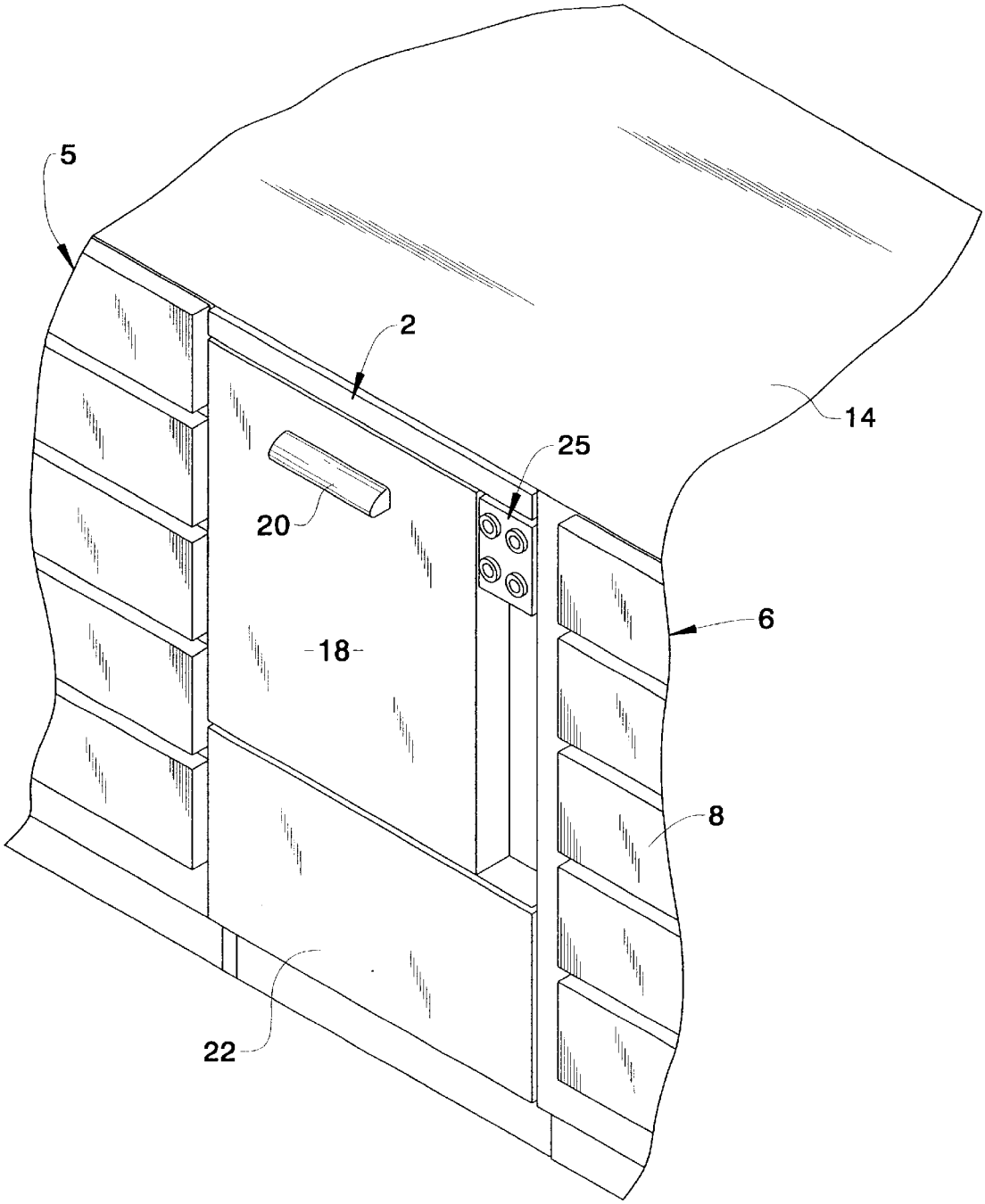
FIG. 1 is a partial perspective view of a refrigeration appliance constructed in accordance with the present invention and arranged beneath a countertop.

With initial reference to FIG. 1, a refrigeration appliance constructed in accordance with the present invention is generally indicated at 2. As shown, refrigeration appliance 2 is situated between kitchen cabinet units 5 and 6 each of which includes a plurality of drawers 8. As exemplified in this figure, appliance 2 fits under a standard kitchen countertop 14 in the manner similar to a dishwasher. However, as will become more fully apparent below, refrigeration appliance 2 can also be used as a stand alone unit. In any event, refrigeration appliance 2 is shown to include a cover member 18 which can be defined by a door or drawer front and which includes a handle 20 for the shifting cover member 18 in order to access an interior portion of refrigeration appliance 2 as will be discussed more fully below. Beneath cover member 18 is provided an access panel 22. Finally, refrigeration appliance 2 is shown to include a control unit 25, the details of which will be also discussed below.

Figure 3:
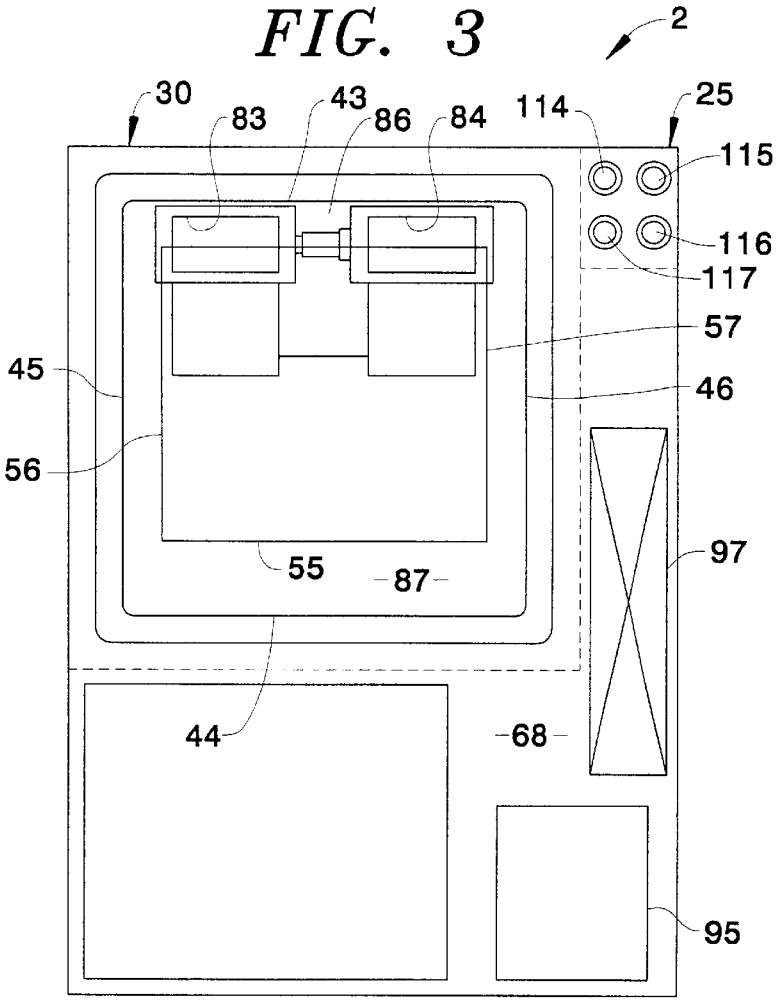
FIG. 3 is a schematic front view of the refrigerator appliance of FIG. 1.
Figure 2:
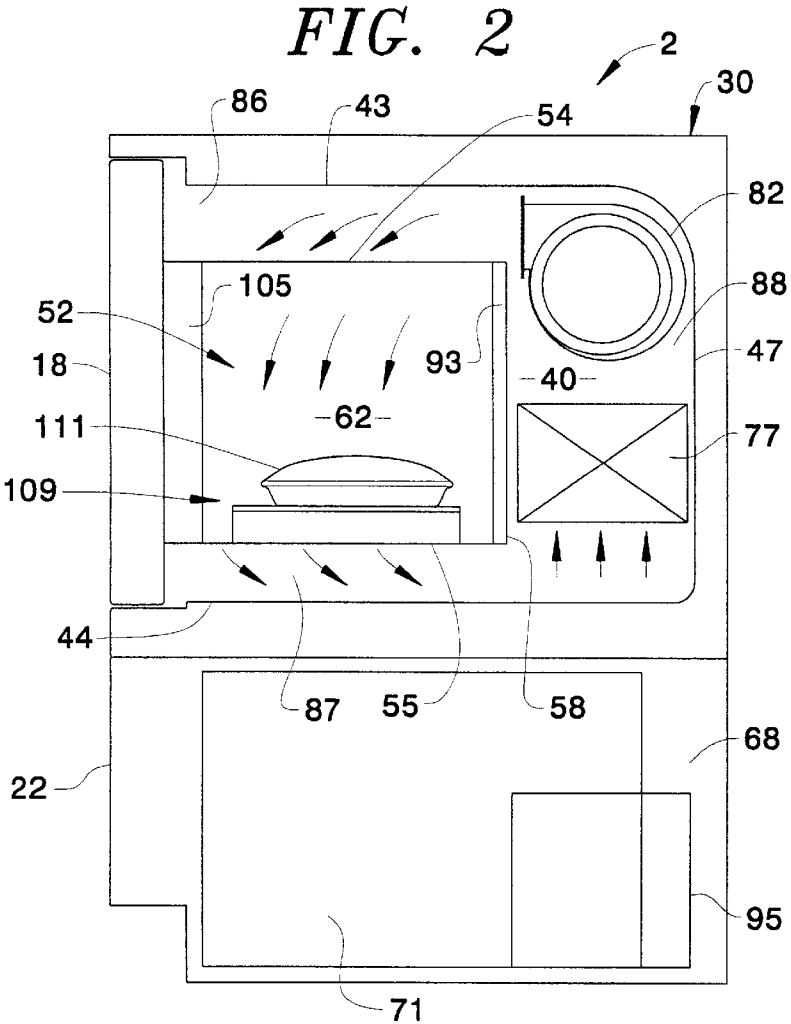
FIG. 2 is a schematic side view of the refrigeration appliance of FIG. 1.

FIGS. 2 and 3 will now be referenced to provide additional structural details of refrigeration appliance 2. In general, refrigeration appliance 2 includes an outer housing 30 within which is formed a chamber 40. More particularly, outer housing 30 includes an upper wall 43, a lower wall 44, side walls 45 and 46 and a rear wall 47 which defines chamber 40. Arranged within chamber 40 is a cavity insert 52 which may include a top 54 but at least includes bottom, opposing side and rear panels 55–58 respectively. Within the confines of top, bottom, side and rear panels 54–58 is formed an internal cavity 62.

At this point, it should be noted that if cover member 18 is constituted by a door which pivots about a generally vertical or horizontal axis, internal cavity 62 is preferably open at a front end portion thereof. On the other hand, cover member 18 can be secured to cavity insert 52 to define a drawer which will be slidably received within outer housing 30, in which case, cavity insert 52 does not include top panel 54 but rather has an open top and cover member 18 seals off the front of the internal cavity 62. In any event, access to internal cavity 62 is provided, either through front or top portions thereof. If cover member 18 and cavity insert 52 define a drawer, internal cavity 62 can either be simply open on the top or a pivoting top panel can be provided thereon, with the cover being provided with one or more openings extending therethrough to allow the flow of a cooling medium into internal cavity 62 as will be discussed more fully below. If top panel 54 exists, such openings, although not shown, are provided.

The space below internal cavity 62 constitutes a machine compartment 68 which can be accessed by the removal of panel 22. Within machine compartment 68 is a condensing unit 71 of a large refrigeration system. The large refrigeration system also includes an evaporator coil 77. Furthermore, a blower 82 is provided for developing a flow of a cooling fluid or medium, preferably air, which is directed through internal cavity 62 in a manner which will be described below. In the most preferred form of the invention, blower 82 includes a pair of laterally spaced air outlets 83 and 84 which initially direct a flow of air into an upper passage 86 defined between upper wall 43 of outer housing 30 and a top 54 of cavity insert 52. Also defined between lower wall 44 of chamber 40 and bottom 55 of cavity insert 52 is a lower passage 87. Upper passage 86 and lower passage 87 are interconnected by a rear passage 88 which is defined between rear wall 47 of chamber 40 and rear panel 58 of cavity insert 52.

In general, the large refrigeration system operates by directing a flow of cooling air initially into upper passage 86, then through internal cavity 62, out internal cavity 62 into lower passage 87 and then the air is directed to blower 82 through rear passage 88. Evaporator coil 77 is positioned within rear passage 88 such that the return air is cooled prior to reaching blower 82.

Refrigeration appliance 2 also preferably incorporates a small refrigeration system that includes an evaporator 93, preferably in the form of a cold plate, a compressor 95, a condenser 97 and a capillary tube (not shown). In the most preferred form of the invention, the small capacity refrigeration system preferably provides cooling, through natural convection, to maintain a desired temperature within internal cavity 62. Refrigeration appliance 2 can also include a thermal storage medium 105, as well as a platform or shelf 109 for supporting a food item, such as the pie indicated at 111 in FIG. 2, within an internal cavity 62. In addition to or in place of platform 109, accessory baskets or pouches designed to contain food items could also be provided within internal cavity 62, such as on the rear portion of cover member 18.

The preferred overall air flow management system preferably incorporated in refrigeration appliance 2 will be discussed further hereinafter. At this point, it should be realized that the large capacity refrigeration system, which is preferably a vapor compression system, can operate to supply cold air at high velocities to internal cavity 62 through the use of blower 82. The supply air can actually enter internal cavity 62 from the top, sides or both the top and sides depending upon the particular type of air flow system employed. The flow of cold air functions to remove heat from the food item 111 contained in internal cavity 62, as well as heat dissipated by blower 82 itself This flow of cooling air exits internal cavity 62 and is redirected to evaporator coil 77 for cooling again. As indicated above, the return air is preferably routed through bottom panel 55 of cavity insert 52, with bottom panel 55 being preferably perforated with an abundance of relatively small holes to avoid introducing food particles into the air flow system.

The large refrigeration system may be used in conjunction with thermal storage medium 105. More particularly, thermal storage medium 105 preferably constitutes a phase-change material corresponding to that commonly sold in connection with portable insulated boxes or coolers, with the phase-change material having a high latent heat of fusion. The high cooling capacity of the large refrigeration system would be used to freeze the phase-change material and then the temperature within internal cavity 62 will be maintained by passing a flow of air upon thermal storage medium 105. It should be realized that thermal storage medium 105 can be readily repositioned, such as above internal cavity 62, such that the flow of air is directed thereover prior to discharging the cooled air into internal cavity 62. Preferably, the phase-change material is made of thin parallel slabs to maximize the surface area thereof. Actually, the size of the large refrigeration system may be reduced in accordance with the invention by using additional thermal storage mediums 105 to supplement additional cooling capacity as needed, especially for performing a blast freezing operation.

In any event, the large capacity refrigeration system is used for the rapid cooling of food items 111 placed within internal cavity 62. On the other hand, the small capacity refrigeration system is utilized to satisfy more nominal refrigeration requirements and to basically maintain a steady state condition within internal cavity 62.

In accordance with the invention, the small capacity refrigeration system can also operate through the use of blower 82. However, the most preferred embodiment simply utilizes natural convection for this cooling process. In any case, control unit 25 includes various control buttons 114–117 for controlling the various components of the large and small refrigeration systems. For instance, control button 114 can activate the large refrigeration system, control button 115 can activate the small refrigeration system, control button 116 can be utilized to separately control blower 82 and control button 117 functions as a top/cancel control element.

Figure 4:
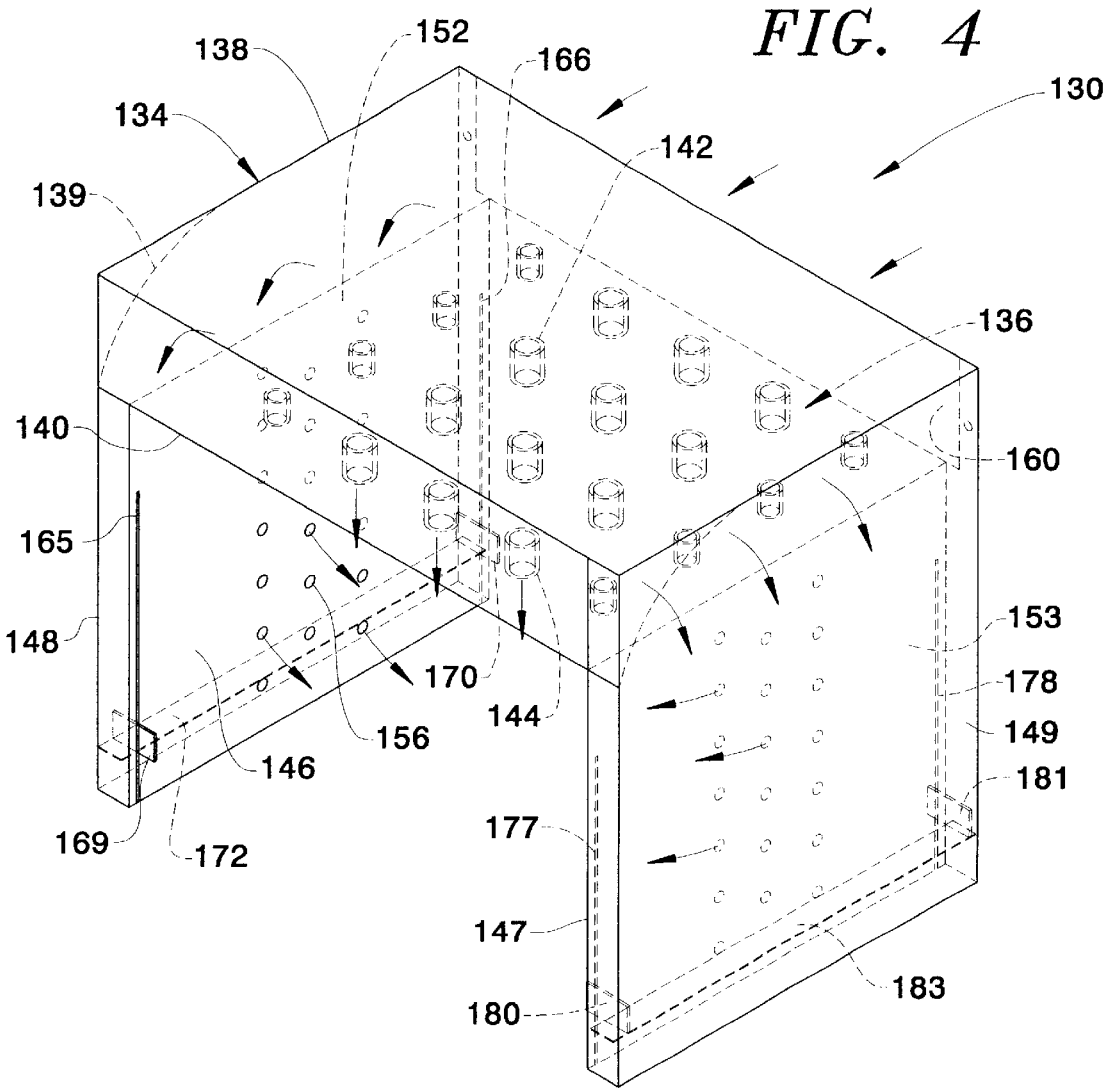
FIG. 4 is a perspective view of an impingement air diffuser arrangement incorporated in the refrigerator appliance of FIG. 1.

As indicated above, internal cavity 62 can be fixed within chamber 40 if cover member 18 defines a door or cavity insert 52 can be slid in and out of chamber 40 in defining an overall drawer in combination with cover member 18. In either case, it is preferable in accordance with the present invention to position an impingement air diffuser 130 (see FIG. 4) around cavity insert 52, with impingement air diffuser 130 defining at least upper passage 86. More specifically, as clearly shown in FIG. 4, impingement air diffuser 130 includes a shell or body 134 that includes a first plenum zone 136. First plenum zone 136 establishes upper passage 86 and includes an upper wall 138 having a curved frontal section 139 that leads to a lower wall 140. Upper and lower walls 138 and 140 are spaced to establish first plenum zone 136. The flow of air generated by blower 82 or through natural convection is directed into first plenum zone 136 as indicated in this figure. Lower wall 140 is formed with a plurality of air inlet ports 142 which preferably have associated therewith respective nozzles 144, with nozzles 144 opening into internal cavity 62.

Shell 134 also includes laterally spaced, inner upstanding side walls 146 and 147, as well as outer upstanding side walls 148 and 149. Between respective inner and outer upstanding side walls 146–149 are formed side channels or passages 152 and 153. In the most preferred form of the invention, each of the inner upstanding side walls 146 and 147 is preferably formed with a plurality of spaced inlet ports 156 which also lead into internal cavity 62. Although not shown, nozzles, corresponding to nozzles 144, can also be provided at inlet ports 156. With this arrangement, air directed into first plenum zone 136 will be caused to flow through air inlet ports 142, while a portion will be diverted into side channels 152 and 153 to inlet ports 156. In this manner, food item 111 positioned within internal cavity 62 will have impinged thereon a flow of cooling air from above and opposing sides.

In the most preferred form of impingement air diffuser 130, shell 134 includes an open rear zone 160 which is simply exposed to rear passage 88. Furthermore, inner upstanding side wall 146 has formed therein upright front and rear slots 165 and 166 respectively. Projecting through slots 165 and 166 are tabs 169 and 170. Within side channel 152, i.e., between inner upstanding side wall 146 and outer upstanding side wall 148, is provided a fore-to-aft extending plate 172. Tabs 169 and 170 are fixedly attached to plate 172. A similar pair of slots 177 and 178 are formed in inner upstanding side wall 147, with corresponding tabs 180 and 181 extending through slots 177 and 178 and being attached to a respective plate 183.

With this arrangement, it should be apparent that plates 172 and 183 can be shifted vertically within channels 152 and 153 respectively. Plates 172 and 183 essentially vary the volume of channels 152 and 153 and limit the number of inlet ports 156 which receive a flow of cooling air from first plenum zone 136. Tabs 169, 170, 180 and 181 are preferably used to support platform 109 such that platform 109 generally constitutes a vertically adjustable shelf. Various types of pins or other securing arrangements can be utilized to fix platform 109 in a desired vertical position, such as with the pins being placed within selected inlet ports 156. On the other hand, other vertically adjustable shelving arrangements could also be incorporated within impingement air diffuser 130, such as a vertically adjustable shelving arrangement corresponding to that disclosed in U.S. patent application 09/079,357 which is pending and incorporated herein by reference. In any case, plates 172 and 183 would move in conjunction with the shelf and act to block the flow of air to inlet ports 156 which are located vertically below plates 172 and 183 within channels 152 and 153. Therefore, all of the air flow developed could be used to directly impinge upon food item 111 placed within internal cavity 62. For the sake of completeness, it has been found that an optimal distance from the exit of nozzles 144 of air inlet ports 142 and the surface of food item 111 is approximately 5 times the diameter of nozzles 144.

Figure 5:
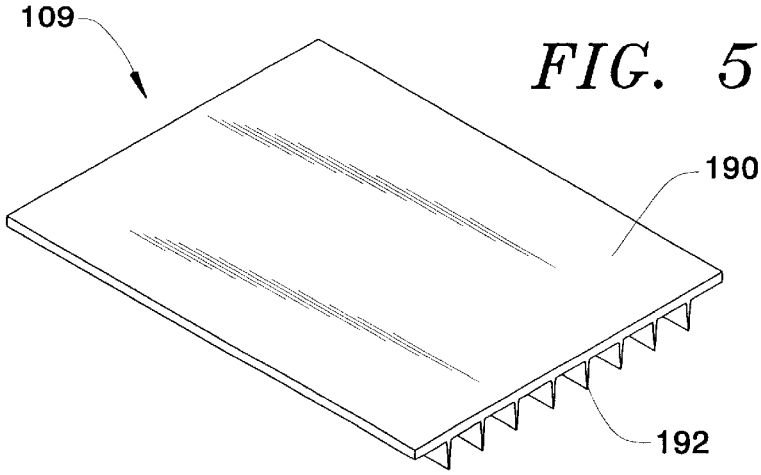
FIG. 5 is a perspective view of a shelf for use in the refrigerator appliance of FIG. 1.

To further aid in the dissipation of heat from food item 111, platform 109 can take the form shown in FIG. 5 so as to include a base 190 provided with a plurality of transversely extending lower fins 192. Fins 192 simply aid in dissipating the heat from the food item and increase the lower surface area associated with platform 109 over which air returning to evaporator coil 77 will flow.

In accordance with this preferred embodiment of the invention, impingement air diffuser 130 simply fits into chamber 40 of refrigeration appliance 2 and can actually define internal cavity 62 or simply be positioned around additional structure which defines internal cavity 62. Upper wall 138 is optimally curved at front section 139 for directing air to nozzles 144, as well as channels 152 and 153. Again, it should be noted that inlet ports 156 could also be provided with nozzles corresponding to nozzles 144, with the various nozzles being either round, slotted or the like. The actual diameters of the nozzles and the space between adjacent nozzles are optimally designed to obtain the largest heat transfer coefficient for a prescribed air flow rate. The preferred diameters of the nozzles 144 are arranged from 0.5 to 0.75 inches, with a preferred spacing between nozzles ranging from 2.5 to 2.75 inches. When nozzles are associated with inlet ports 156, the preferred diameter is in the order of 0.3 inches, with a spacing of approximately 0.5 inches. Base 190 of platform 109 is preferably formed of aluminum.

Figure 6:
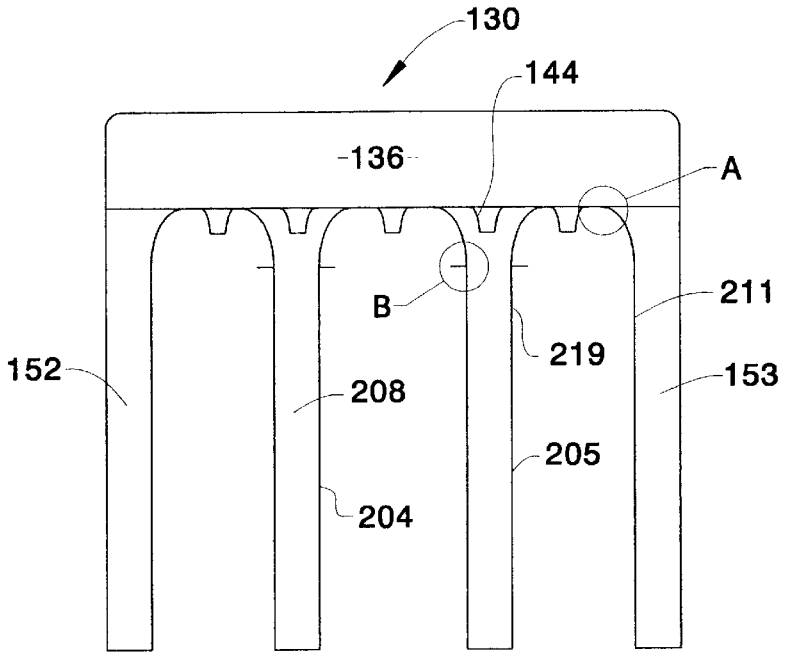
FIG. 6 is a front elevational view of a modified air diffuser arrangement constructed in accordance with the present invention.

It should also be realized that impingement air diffuser 130 can take various forms. For instance, FIG. 6 illustrates a modified form where in partition members 204 and 205 are added such that internal cavity 62 is divided into various sub-spaces for different food packages. Each of partition members 204 and 205 defines a respective vertical channel 208 that is aligned with a set of nozzles 144 and which also includes corresponding side inlet ports (not shown) analogous to ports 156. By controlling the diameters of the various nozzles, it is possible to control the air flow rate into each of the different sub-spaces so that different food items placed in the various subspaces can be actually cooled at different rates or degrees.

Figure 7:
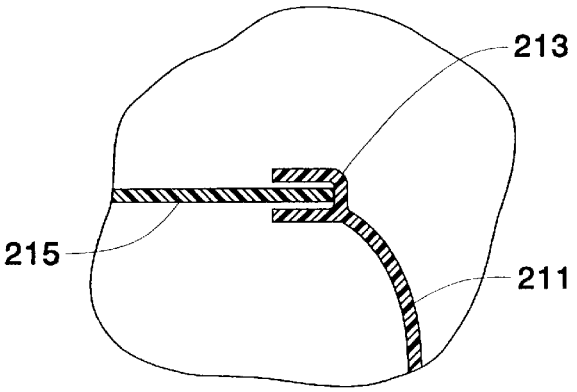
FIG. 7 is an enlarged cross-sectional view of portion A in FIG. 6.
Figure 8:
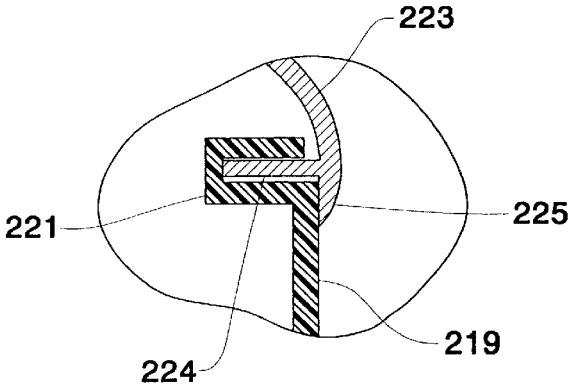
FIG. 8 is an enlarged, cross-sectional view of portion B of FIG. 6.

FIGS. 7 and 8 show preferred constructions associated with impingement air diffuser 130. That is, each of these side walls 146 and 147 preferably takes the form of a vertical panel 211 having a generally U-shaped terminal end 213 which receive a generally horizontal panel end 215, with panel end 215 defining a portion of lower wall 140. At another section, partition members 204 and 205 each include a panel portion 219 formed with a U-shaped terminal end 221 and a curved partition portion 223 having a lateral flange 224 that projects within the U-shaped terminal end 221. The partition portion 223 is also formed with an extension 225 to enhance the overall sealing arrangement. The material utilized in connection with an impingement air diffuser 130 can vary in accordance with the present invention. Preferably, either sheet metal or plastic is utilized.

When used for rapid cooling, blower 82 functions to deliver air into internal cavity 62 such that a preferred static pressure head of 0.7 to 1.0 inch water is created in the first plenum zone 136. Again, the overall air flow is distributed into internal cavity 62 through air inlet ports 142 and 156 in order to impinge upon food item 111. For the large capacity refrigeration system, the flow of air is of high velocity, preferably in the order of 3000 to 4000 ft/min, with the air passing through nozzles 144 thereby converting the static pressure head to kinetic energy. In any event, the overall system can be utilized to rapidly cool food items 111 placed within internal cavity 62 by direct air impingement upon the food items 111. Once a desired temperature is maintained within internal cavity 62, the small capacity refrigeration system can be automatically activated through the use of control unit 25 and an associated temperature sensor (not shown) in order to maintain the desired temperature within internal cavity 62. On the other hand, if rapid cooling is not needed, refrigeration appliance 2 can simply be utilized with the small capacity refrigeration system which, as indicated above, preferably utilizes natural convention to develop the flow of cooling air through internal cavity 62 but which can also be used in combination with blower 82, which could operate at variable speeds for the large and small capacity refrigeration systems respectively. In any event, the small capacity refrigeration system is simply more energy efficient than the large capacity system.

Based on the above, it should be readily apparent that, with the incorporation of both large and small refrigeration systems, a versatile refrigeration appliance is established. The air flow distribution system, either taken singly or in combination with the vertically adjustable support platform, provides an efficient air distribution arrangement for impingement upon the food items placed within the internal cavity. The potential use of the thermal storage medium further enhances the overall efficiency of refrigeration appliance 2. In any event, although described with respect to preferred embodiments of the invention, it should be readily understood that various changes and/or modifications can be made to the invention without departing from the spirit thereof. Instead, the invention is only intended to be limited by the scope of the following claims.

We claim:

1. A refrigeration appliance comprising:

a housing including an internal cavity having an open portion for accessing the internal cavity from outside the housing;

a fluid flow assembly including first, second and third passages, said first and second passages being interconnected by said third passage;

a plurality of fluid entry ports leading into the internal cavity from the first passage;

at least one fluid exit port leading from the internal cavity into the second passage;

a first, large capacity refrigeration system for developing a flow of and rapidly cooling a fluid medium, said fluid medium being directed into the first passage of the fluid flow assembly, the internal cavity through the plurality of fluid entry ports for impingement upon a food item placed in the internal cavity, the second passage through the at least one fluid exit port and back to the first passage through the third passage; and a second, small capacity refrigeration system for maintaining a desired temperature environment within the internal cavity through the fluid medium.

2. The refrigeration appliance according to claim 1, wherein the large capacity refrigeration system comprises a vapor compression system including an evaporator and a condensing unit.

3. The refrigeration appliance according to claim 2, further comprising a blower for developing the flow of the fluid medium.

4. The refrigeration appliance according to claim 3, further comprising: a thermal storage medium arranged in one of the fluid flow assembly and the internal cavity, said thermal storage medium including a phase-change material adapted to be frozen by the fluid medium.

5. The refrigeration appliance according to claim 3, further comprising: a plurality of impingement nozzles, each of said nozzles being aligned with a respective one of the plurality of fluid entry ports, wherein the fluid medium is directed into the internal cavity through the nozzles, with the fluid medium being adapted to impinge upon food items placed within the internal cavity.

6. The refrigeration appliance according to claim 5, further comprising: an impingement air diffuser positioned within the internal cavity, said impingement air diffuser including top and side panels, wherein said impingement nozzles are provided at the top panel and wherein a number of the plurality of fluid entry ports are formed in the side panels.

7. The refrigeration appliance according to claim 6, wherein the impingement air diffuser includes at least one divider which defines an internal air channel and which partitions the internal cavity into multiple sub-spaces.

8. The refrigeration appliance according to claim 3, wherein the small capacity refrigeration system utilizes natural convection in circulating the fluid medium through the internal cavity.

9. The refrigeration appliance according to claim 8, wherein the small capacity refrigeration system includes an evaporator, a compressor and a condenser, with the evaporator constituting a cold plate element.

10. The refrigeration appliance according to claim 5, wherein the blower generates a flow of the fluid medium having a velocity in the range of 3000 to 4000 ft/min.

11. The refrigeration appliance according to claim 3, wherein a static pressure head in the range of 0.7 to 1.0 inch $H_2O$ is established in the first passage.

12. The refrigeration appliance according to claim 1, wherein the refrigeration appliance is mounted below a kitchen countertop.

13. The refrigeration appliance according to claim 1, further comprising a pair of laterally spaced side wall channels which are in fluid communication with the first passage, at least some of the plurality of fluid entry ports being formed in the side walls to fluidly interconnect the channels with the internal cavity.

14. The refrigeration appliance according to claim 13, further comprising a shelf positioned within the internal cavity for supporting a food item.

15. The refrigeration appliance according to claim 14, further comprising: means for vertically adjusting the shelf within the internal cavity.

16. The refrigeration appliance according to claim 14, wherein the shelf includes a base and a plurality of elongated fins projecting from a bottom portion of the base.

17. The refrigeration appliance according to claim 13, further comprising: first and second blocking plates respectively positioned in the side wall channels, said blocking plates being selectively, vertically shiftable within the channels in order to block off a selected number of the plurality of fluid entry ports provided in the side walls.

18. A refrigeration appliance comprising:

a housing including an upper wall, side walls and a rear wall;

an internal cavity arranged within the housing, with the internal cavity being defined by top, bottom and side panels, said top panel being spaced from said upper wall so as to define a first passage therebetween, said side panels being spaced from said side walls to define a pair of spaced vertical channels which open up into the first passage;

a plurality of entry ports provided in each of the top and side panels in order to fluidly interconnect each of the first passage and the side channels with the internal cavity;

a refrigeration system including a blower for generating a flow of cooling air directed into at least the first passage; and first and second blocking plates arranged in the opposing side channels, said blocking plates being selectively, vertically adjustable within the side channels for restricting the flow of fluid through a selected number of the entry ports in the side panels.

19. The refrigeration appliance according to claim 18, further comprising: a pair of substantially spaced vertical slots provided in each of the side panels and a plurality of shelf support members, each of said shelf support members being attached to a respective one of the blocking plates and being slidably positioned within one of the slots, said support members being adapted to support a shelf thereon within the internal cavity.

20. The refrigeration appliance according to claim 18, further comprising: a plurality of impingement nozzles, each of said nozzles being aligned with a respective one of the plurality of fluid entry ports, wherein the flow of cooling air is directed into the internal cavity through the nozzles, with the flow of cooling air being adapted to impinge upon food items placed within the internal cavity.

21. The refrigeration appliance according to claim 18, further comprising: an impingement air diffuser positioned in the housing and defining, at least in part, the internal cavity, the first passage and the pair of spaced vertical channels.

22. The refrigeration appliance according to claim 21, wherein the impingement air diffuser includes at least one divider which defines an internal air channel and which partitions the internal cavity into multiple sub-spaces.

23. The refrigeration appliance according to claim 18, further comprising: a second, lower capacity refrigeration system for maintaining a desired temperature environment within the internal cavity.

* * * * *